US006416379B1

(12) United States Patent
Topman

(10) Patent No.: US 6,416,379 B1
(45) Date of Patent: Jul. 9, 2002

(54) WHISTLE

(75) Inventor: Simon M. Topman, Sutton Coldfield (GB)

(73) Assignee: J. Hudson & Co. (Whistles) Ltd., Hockley (GB)

( * ) Notice: Subject to any disclaimer, the term of this patent is extended or adjusted under 35 U.S.C. 154(b) by 0 days.

(21) Appl. No.: 09/560,030

(22) Filed: Apr. 27, 2000

(51) Int. Cl.[7] ..... A63H 5/00

(52) U.S. Cl. ..... 446/204; 446/202; 446/404; 24/302

(58) Field of Search ..... 446/204, 205, 446/206, 202; 224/191, 219–222, 267, 250, 255, 910, 257, 258; 116/137 R; 24/3.2, 3.4, 3.12

(56) References Cited

U.S. PATENT DOCUMENTS

| | | | | |
|---|---|---|---|---|
| 303,139 | A | * | 8/1884 | Farnham |
| 1,258,077 | A | * | 3/1918 | Worcester |
| 2,961,135 | A | * | 11/1960 | Hughes, Jr. |
| 4,392,325 | A | * | 7/1983 | Woronets ..... 46/179 |
| 5,002,006 | A | * | 3/1991 | Ehrenreich ..... 446/137 R |
| 5,607,091 | A | * | 3/1997 | Musacchia ..... 224/222 |
| 6,109,490 | A | * | 8/2000 | Caluori ..... 224/220 |

FOREIGN PATENT DOCUMENTS

GB 25619 7/1908

OTHER PUBLICATIONS

P. 4 from a product catalog of J. Hanson & Co. (Whistles) Ltd. entitled "The Metropolitan Whistle". See No. 248.
P. 3 from a product catalog of J. Hudson & Co. (Whistles) Ltd. entitled"Acme Thunderer Whistle". See No. 246/1/2.
P. 13 from a product catalog of J. Hudson & Co. (Whistles) Ltd. entitled "Acme Reed Horns". See No. 404.
Two pages depicting a whistle identifies as the "WRISTLE" offered by Phantom Enterprises, Ltd. Middleton, WI.
The color picture "A" shows the whistle removed from its carton ("B") that has a backside "C".

* cited by examiner

*Primary Examiner*—Valencia Martin-Wallace
*Assistant Examiner*—Alex F. R. P. Rada, II
(74) *Attorney, Agent, or Firm*—Welsh & Katz, Ltd.

(57) ABSTRACT

A whistle of generally mandolin shape is adapted for adjustable mounting or seating on one's hand, wrist or forearm, or on a bulky sports glove or the like in a position facilitating convenient blowing of the whistle. A bracket is fixed generally tangentially to a generally cylindrically shaped whistle chamber portion of the whistle and has openings therethrough to receive a flexible strap that facilitates mounting of the whistle on one's hand, wrist or forearm, or on a bulky glove or the like with a mouthpiece portion of the whistle extending outwardly for convenient access for blowing. The strap defines a plurality of transverse ridges along its length that cooperate with the bracket to substantially prevent movement of the whistle along the strap when the strap is in a longitudinally taut condition.

21 Claims, 1 Drawing Sheet

WHISTLE

BACKGROUND OF INVENTION

The present invention relates generally to whistles, and more particularly to a whistle that is particularly adapted for mounting on one's hand or forearm or on a relatively bulky sports glove or the like to facilitate convenient blowing of the whistle.

Many activities that involve groups of participants, such as team sports, entail interruptions during practice for instructional purposes. For example, coaches of soccer, ice hockey, field hockey and lacrosse teams, to name a few, frequently stop training practices and intra team scrimmage sessions to comment or instruct on one or more facets of a player's technique or on team performance. In those sports where the coach may utilize a whistle to get the attention of the players but does not wish to carry the whistle on a lanyard about his/her neck so as to require grasping of the whistle with a free hand to facilitate blowing, and in particular in sports where the coach may wear protective gloves as worn by the players during practices, it is a conventional practice for the coach to support the whistle on his/her hand or forearm to facilitate blowing, thereby leaving the coaches hands free for other uses. In situations where the coach wears bulky padded gloves, the problem is more acute because the gloves do not readily allow grasping of a whistle between the thumb and a finger to position the whistle for blowing. Moreover, the bulk of the gloves leads to a lack of "feel" when attempting to grasp a small article such as a whistle that might be worn on a lanyard about the coaches neck. To overcome the inconvenience of having to grasp a whistle between one's thumb and index finger in order to blow the whistle, particularly acute for coaches and the like, one known prior whistle mounts the whistle on a wrist band that can then be wrapped and buckled about the user's hand, wrist or forearm. Another known whistle that is promoted for mounting on a padded sports glove utilizes an elastic cord or lanyard that is attached to a whistle and can be wrapped about a sports glove to secure the whistle to the glove. The latter requires that the elastic cord or lanyard be fitted into a crease or groove in the glove, such as created where the glove cuff meets the thumb/backhand padding, so as to seat the whistle into the groove.

The aforedescribed prior whistles having a strap or elastic lanyard that enables the whistle to be worn on one's wrist or forearm or attached to a bulky sports glove exhibit a significant drawback in that they do not adequately retain the whistle in a selected relatively fixed optimum position for blowing. This can cause a delay in the ability to blow the whistle at the exact moment desired by the coach, as well as requiring periodic re-positioning of the whistle with corresponding distraction from observing player activity.

A need thus exists for a whistle that can be readily mounted on ones hand, wrist or forearm, or on a bulky sports glove or the like, in a position to facilitate convenient blowing and that will firmly retain its selected position on the hand, wrist, forearm or glove.

SUMMARY OF THE INVENTION

Accordingly, one of the primary objects of the present invention is to provide a whistle that may be readily mounted on one's hand, wrist or forearm or on a sports glove in a position facilitating convenient blowing, and that will remain in the selected position during active movement of the user.

Another object of the invention is to provide a whistle of the mandolin shape having a contoured bracket fixed to the generally cylindrically shaped portion of the whistle, the bracket having openings therethrough to receive a flexible strap that facilitates selective attachment of the whistle to one's hand, wrist or forearm, or to a bulky sports glove or the like, and wherein the strap cooperates with the bracket to prevent movement of the whistle from its selected position when the strap is in a taut condition.

Another object of the present invention is to provide a whistle of a generally mandolin shape that is particularly adapted for mounting on a bulky glove, such as a padded sport glove, and wherein the whistle has a contoured bracket that is fixed tangentially to the generally cylindrical portion of whistle and has a pair of rectangular openings formed therethrough that receive a flexible strap adapted to encircle the glove and maintain the bracket against the glove with the mouthpiece portion of the whistle extending outwardly from the glove, the strap being cooperable with the bracket to maintain the whistle in a selected position along the length of the strap.

A feature of the whistle in accordance with the present invention lies in utilizing a flexible strap having transverse ridges cooperate with the contoured bracket so as to maintain the whistle in a desired position along the strap when the strap is in a taut condition.

Another feature of the whistle in accordance with the invention lies in utilizing an elongated flexible strap having hook-like elements formed on one surface thereof so as to enable placement of the strap around one's hand, wrist or forearm, or around a bulky sports glove or the like, with the hook-like element surface in overlapping releasable interlocking relation with the opposite surface of the strap to maintain the strap firmly in a selected position.

Another feature of the whistle in accordance with the present invention lies in forming the mounting bracket in a sine wave-like profile to facilitate mounting of the whistle in relatively fixed relation on one's hand, wrist or forearm, or on a flat, grooved or rounded surface of a padded sports glove, thus enabling the whistle to be firmly located on the edge-of-hand, back-of-hand, wrist or fingers for convenient access by the user.

Still another feature of the invention lies in forming the mounting bracket in a sine wave like contour such that the strap is spaced from a portion of the bracket as it passes through the openings in the bracket in a taut condition. In this manner, movement of the whistle, after the strap is made taut about one's hand, wrist, forearm or a glove, to a position wherein a spaced portion of the strap is urged toward the bracket further tightens the straps cooperation with the bracket to maintain the strap and whistle in relatively fixed relation.

Further objects, features and advantages of the whistle in accordance with the present invention will become apparent from the following detailed description taken in conjunction with the accompanying drawings wherein like reference numerals designate like elements throughout the several views.

BRIEF DESCRIPTION OF THE DRAWINGS

FIG. 6 is a foreshortened plan view of the opposite side of the strap from that shown in FIG. 5 illustrating the woven-like surface that enables releasable interlocking with the hook-like element surface when the strap is secured about a sports glove or the like.

DETAILED DESCRIPTION

Figure 1:
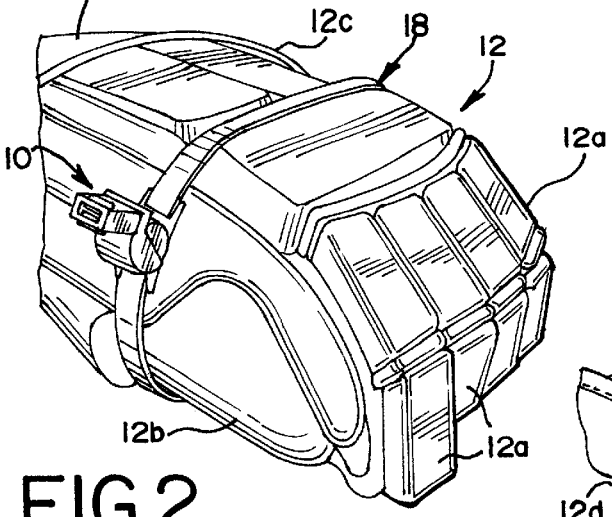
FIG. 1 is a fragmentary perspective view of a sport glove having a whistle in accordance with the present invention mounted thereon.

Referring now to the drawings, and in particular to FIG. 1, a whistle constructed in accordance with a preferred embodiment of the present invention is indicated generally at 10. The whistle 10 is shown secured on a glove 12 that, in the illustrated embodiment, comprises a sports glove such as worn in ice hockey. Sports gloves of this type are well known and are worn in various sports, such as lacrosse and field hockey, in addition to ice hockey. The gloves are relative bulky and include padded finger receiving portions 12*a* and a thumb receiving portion 12*b* secured to a hand receiving portion 12*c* that has padding protecting the back of the hand and wrist area. A padded barrel shaped portion 12*d* of the glove receives and protects the forearm portion of the wearer. The various pads on the glove are segmented or separated by creases to enable articulation between the pads to accommodate hand, finger and wrist movement of the wearer.

As aforedescribed, in many team sports such as ice hockey and lacrosse where the players wear protective gloves, it is a common practice for the coaches to wear similar gloves during practices and scrimmages. Because the padded protective gloves are relatively bulky, it is difficult to readily grasp and blow a whistle, such as worn on a lanyard about the coaches neck, in order to get the players attention. As will become apparent, the whistle 10 is adapted to be mounted on one's hand, wrist or forearm, or on a sports glove or the like so as to firmly position the whistle for easy access and blowing by the user.

Briefly, the whistle 10 includes a mandolin shaped body or housing 14 having a contoured bracket 16 fixed thereto. A flexible strap 18 extends through openings in the bracket 16 and is adapted to be readily secured around one's hand, wrist or forearm, or around the glove 12 so that a tubular mouthpiece portion 20 of the whistle body extends outwardly from the glove or the user's hand, wrist or forearm on which the whistle may be mounted. As will be described, the strap 18 cooperates with the bracket 16 to retain the whistle in selected position along the strap when in a taut condition.

Figure 2:
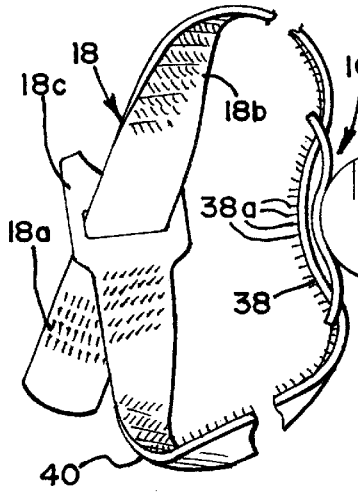
FIG. 2 is a side elevational view of the whistle of FIG. 1 removed from the glove with the strap for securing the whistle on the glove shown foreshortened and with the lip cushion removed from the whistle.
Figure 2:
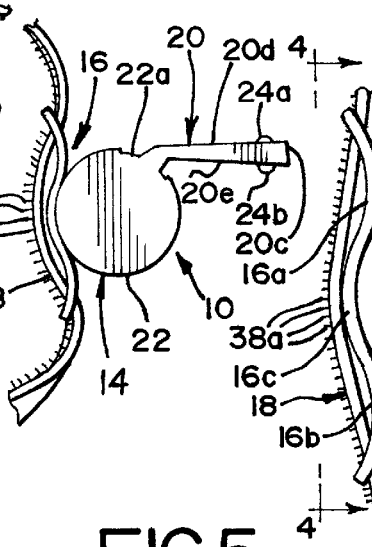
Figure 3:
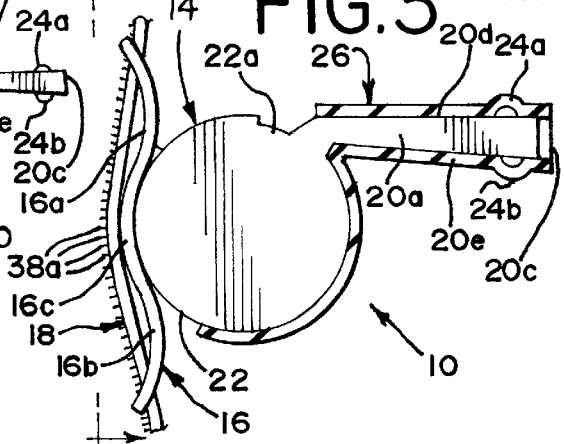
FIG. 3 is a side elevational view of the mandolin shaped whistle and contoured bracket with a fragmentary portion of the strap shown extending through the bracket in a taut condition and with the lip cushion being shown in longitudinal section.

As illustrated in FIGS. 2 and 3, the whistle housing 14 is formed as a flat-topped mandolin shaped body, as considered in side profile or elevation. The mouthpiece portion 20 is formed integral with a bulbous or generally cylindrical shaped hollow portion 22 that defines the whistle chamber. The whistle body may be formed of a suitable metallic material or molded plastic. The mouthpiece portion 20 is formed as an elongated tubular air passage having a substantially rectangular transverse cross section. Sidewalls of the mouthpiece portion, one of which is indicated at 20*a* in FIG. 3, preferably taper inwardly symmetrical to a longitudinal axis of the mouthpiece portion from its intersection with the bulbous portion to a forward end 20*c*. Upper and lower walls 20*d* and 20*e* of the mouthpiece portion diverge as they extend from the bulbous portion 22 to the forward end 20*c*. A pair of raised ribs or ridges 24*a* and 24*b* are preferably formed, respectively, to extend outwardly from the upper and lower walls 20*d* and 20*e* of the mouthpiece portion 20 adjacent the forward end 20*c* and transverse to the longitudinal axis of the mouthpiece portion. The ribs or ridges 24*a,b* enable the user to better retain the whistle between his/her lips or teeth during blowing.

The mouthpiece portion 20 intersects the bulbous portion 22 generally tangentially adjacent a rectangular air exhaust port 22*a* so that air blown into the whistle chamber internally of the bulbous portion is exhausted through the exhaust port, as is known. The whistle 10 is of the pea type having a small spherical pea within the bulbous chamber 22. However, the whistle 10 could alternatively comprise a pealess type whistle as disclosed in U.S. Pat. No. 5,086,726 that is incorporated herein by reference. If desired, a formed rubber insulator cover 26 may be provided to releasably fit over the mouthpiece portion 20 and the forwardly exposed portion of the bulbous shaped chamber 22 to insulate the user's lips from the whistle body when used in cold environments, such as ice arenas and the like.

Figure 4:
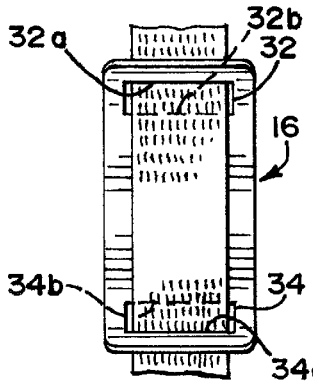
FIG. 4 is rear end view taken substantially along line 4—4 of FIG. 3 and showing the contoured bracket in elevation with the strap removed.

The bracket 16 is fixed generally tangentially to the bulbous portion 22 of the whistle. The bracket 16, which may be termed a stabilizing bracket, is rectangular and also made of a suitable strength metal or plastic. The bracket has a contoured side edge profile in the form of a sine wave like contour, alternatively termed a sine waveform curvature edge profile, as illustrated in FIG. 3. Bracket 16 has a pair of rectangular openings 32 and 34 therethrough adjacent opposite ends of the bracket, as seen in FIG. 4. The rectangular openings 32, 32 are defined in part by parallel edge surfaces 32*a,b* and 34*a,b* respectively, formed transverse to the longitudinal axis of bracket 16. The bracket is preferably fixed tangentially to the bulbous chamber portion 22 of the whistle so as to lie generally in a plane normal to a plane that is parallel to the axial centerline of the bulbous portion and contains the longitudinal centerline of the mouthpiece portion 20.

Figure 5:
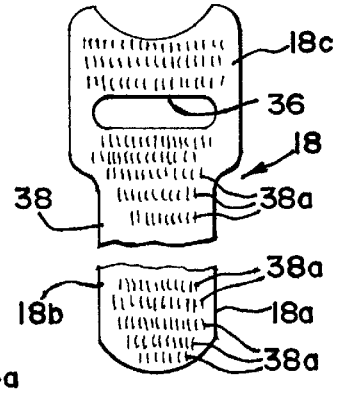
FIG. 5 is a foreshortened plan view of one side of the strap, on an enlarged scale, illustrating the hook-like elements formed in transverse rows to establish transverse ridges for cooperation with the contoured bracket to maintain the whistle in selected position along the length of the strap when mounted on a glove or one's hand or arm.
Figure 6:
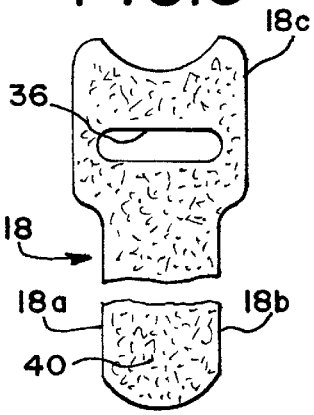

The openings 32 and 34 in bracket 16 receive the elongated flexible strap 18 therethrough to facilitate mounting of the whistle on glove 12. As illustrated in FIGS. 5 and 6, the strap 18 has laterally opposite longitudinally marginal edges 18*a* and 18*b* and an enlarged end 18*c* having a generally transverse opening 36 to receive the opposite end of the strap when securing the strap about one's hand, wrist or forearm or about the glove 12 in a loop-like fashion as illustrated in FIGS. 1 and 2. One side surface 38 of the strap is formed along its length with a plurality of outwardly projecting hook-like elements that may be formed of a plastic material and are disposed in relatively closely spaced transverse rows, as indicated at 38*a* in FIG. 5. The rows of hook-like elements define transverse ridges that create a serrated side edge profile along the length of the strap.

Figure 7:
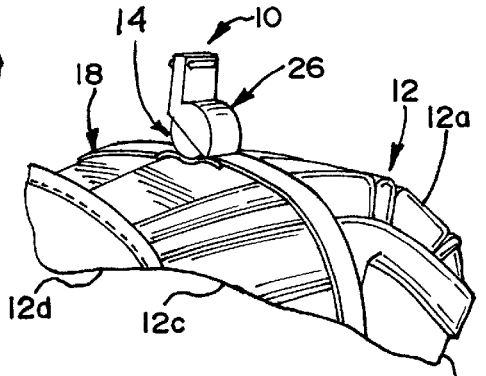
FIG. 7 is a fragmentary perspective view similar to FIG. 1 but showing the whistle mouthpiece positioned to extend outwardly from the padded back-of-hand portion of the glove.

The opposite surface 40 of strap 18 is formed along its length with a woven fabric type surface that facilitates releasable connection with the hook-like elements on the surface 38 of the strap when the surface 38 is looped so that it engages surface 40 in surface-to-surface contact. Such attachment means are commercially known under the trademark VELCRO. By forming the hook-like elements on strap surface 38 in transverse rows, when the strap is passed through the openings 32 and 34 in the bracket 16 with surface 38 facing outwardly from outer exposed concave surfaces 16*a* and 16*b* and the intervening convex surface 16*c* of the bracket, as illustrated in FIG. 3, the edge surfaces 32*a* and 34*a* on the bracket cooperate with the adjacent transverse rows or ridges 38*a* of hook-like elements on the strap to maintain the whistle in relatively fixed relation along the length of the strap when the strap is taut. In this manner, the whistle 10 may be readily mounted on one's hand, wrist or forearm, or on a glove such as the bulky sports glove 12, by securing the strap about the hand, etc. or glove with the whistle in a position most convenient to be easily blown by a person using the whistle. The strap may be releasably secured to itself so as to be taut about the hand, wrist, forearm or glove with the bracket 16 juxtaposed to one's skin or the glove and with the whistle being held in relatively fixed relation along the length of the strap by cooperation of the transverse serrations on the strap with the transverse edges 32*a*, 34*a* of the bracket. The contour profile of the bracket 16 enables the whistle to be located and retained on flat or rounded ridge-like surfaces of the padded glove with the mouthpiece portion 20 projecting outwardly from the glove. The whistle may thus be positioned on the glove at a position best suited for use by the person wearing the glove such as, for example, on an edge of the hand portion of the glove, as illustrated in FIG. 1, or on the back-of-hand or padded finger portion of the glove as illustrated in FIG. 7. After positioning the whistle and securing the strap 16 in a taut condition, the wearer is assured that the whistle will not change position on the glove.

By forming the bracket 16 with a sine wave like contour as illustrated in FIG. 3, when the strap 18 extends through the bracket openings 32 and 34 in a longitudinal taut condition, as when secured tautly about one's hand, wrist or forearm, or about the glove 12, the strap is spaced from the concave surfaces 16*a* and 16*b* on the bracket. In this manner, after initially securing the strap in a relatively taut position about, for example, the glove 12 with the bracket juxtaposed to a relatively flat surface of the glove, such as the pads on the backhand portion of the glove, the whistle may be moved, either relative to the strap or jointly with the strap, to a location wherein a curved exterior surface of the glove acts against either or both portions of the strap opposite the concave surfaces 16*a* and 16*b*. This action tends to increase the longitudinal tautness of the strap on the glove which in turn tightens the strap and increases frictional engagement between the strap and the bracket opening edges 32*a* and 32. This same result occurs when the whistle is initially mounted on a generally flat surface of one's hand, wrist or forearm and then moved to a position adjacent an area of the hand, wrist or forearm that urges the strap toward either of the concave bracket surfaces 16*a* or 16*b* to increase the taut condition of the strap.

While a preferred embodiment of the whistle in accordance with the present invention has been illustrated and described, it will be understood that changes and modifications may be made therein without departing from the invention in its broader aspects. Various features of the invention are defined in the following claims.

What is claimed is:

1. A whistle for mounting on one's body or a glove so as to be readily accessible for blowing, said whistle comprising a housing having a mouth piece portion and a generally bulbous shaped portion, a substantially rigid bracket affixed to said bulbous portion and having a general waveform edge profile defining at least one pair of openings therethrough, and an elongated flexible strap passing slidably through said openings, said strap being fastenable about a body member or glove so that said mouth piece portion extends outwardly therefrom for blowing, said strap and said bracket enabling movement of said whistle along said strap and being mutually cooperable to maintain the whistle in relatively fixed relation along the length of said strap when said strap is in a longitudinally taut condition.

2. A whistle as defined in claim 1 wherein said strap has longitudinal edges and opposite side surfaces, at least one of said side surfaces having a plurality of hook-like elements enabling releasable attachment to the other side surface when in surface-to-surface engagement therewith.

3. A whistle as defined in claim 2 wherein said bracket is secured to said bulbous portion in generally tangential relation thereto so as to lie in a plane generally normal to a plane parallel to an axial centerline of said bulbous portion and parallel to a centerline of said mouthpiece portion.

4. A whistle as defined in claim 3 wherein said bracket has a generally sine waveform curvature edge profile.

5. A whistle as defined in claim 1 wherein said strap has opposite ends, one of said ends having an opening operative to receive the opposite end of the strap therethrough so as to form a closed loop, said strap being selectively attachable to itself so as to enable selective sizing of the loop.

6. A whistle as defined in claim 1 wherein said bracket has an undulating edge profile so that a portion of said strap extending between said openings is engaged by said bracket in a direction to urge said strap into frictional engagement with edge portions of said openings when said strap is in a longitudinally taut condition.

7. A whistle for mounting on one's body or a glove so as to be readily accessible for blowing, said whistle comprising a housing having a mouth piece portion and a generally bulbous shaped portion, a bracket affixed to said bulbous portion and having at least one pair of openings therethrough, each of said openings being defined along at least a portion of the periphery thereof by a straight edge, and an elongated flexible strap passing slidably through said openings, said strap being fastenable about a body member or glove so that said mouth piece portion extends outwardly therefrom for blowing, said strap defining a plurality of transverse ridges cooperable with said straight edges to maintain the whistle in selected position along said strap when in a generally longitudinally taut condition.

8. A whistle as defined in claim 7 wherein said openings in said bracket are rectangular shaped and defined in part by said straight edges disposed parallel to a centerline of said bulbous portion of said body.

9. A whistle comprising a body member having a mouth piece portion and a whistle chamber portion, a bracket affixed to said whistle chamber portion and having a generally waveform edge profile and at least one opening therethrough defining an edge surface, and an elongated flexible strap passing through said opening, said strap being fastenable about a user's hand or arm or a glove worn thereon so that said mouth piece portion extends outwardly therefrom, said strap and bracket enabling movement of said whistle along said strap when said strap is in a relaxed condition, and being mutually cooperable to maintain the whistle in relatively fixed relation along the length of said strap when taut about the user's hand, arm or a glove thereon.

10. The whistle as define in claim 9 wherein said body member is of a generally flat-top mandolin shape, said whistle chamber portion being defined by a generally cylindrical shaped portion intersected by said mouthpiece portion, said bracket being affixed substantially tangentially to said cylindrical shaped portion.

11. The whistle defined in claim 10 wherein said bracket is secured to said generally cylindrical shaped portion of said body so as to lie generally in a plane substantially normal to a plane parallel to an axial centerline of said cylindrical shaped portion and a centerline of said mouthpiece portion.

12. The whistle defined in claim 9 wherein said bracket has a pair of openings therethrough each of which is defined along at least a portion of the periphery thereof by a straight edge, said strap having a plurality of transverse ridges formed thereon cooperable with said straight edges to maintain the whistle in selected position on said strap when taut about the user's hand, arm or a glove thereon.

13. The whistle defined in claim 11 wherein said strap has opposite side surfaces at least one of which has a plurality of hook-like elements thereon operative to be releasably attached to the other side surface when in surface-to-surface engagement therewith.

14. The whistle defined in claim 11 wherein said bracket has a generally sine waveform curvature edge profile.

15. The whistle defined in claim 12 wherein said openings in said bracket are rectangular shaped and disposed generally adjacent opposite ends of said bracket, said openings each having a straight edge disposed parallel to a centerline of said whistle chamber portion of said body.

16. The whistle defined in claim 12 wherein said strap has opposite ends, one of said ends having an opening therethrough operative to receive the opposite end of the strap therethrough so as to form a closed loop, said strap being selectively attachable to itself so as to enable selective sizing of the loop.

17. A whistle comprising a generally mandolin shaped body having a mouthpiece portion and a generally bulbous shaped whistle chamber portion, a substantially rigid bracket affixed to said bulbous shaped portion and having a generally sine waveform curvature edge profile, and strap means for securing said bracket to a sports glove or the like so that said mouthpiece portion extends outwardly therefrom, said strap means being cooperative with said bracket so as to enable movement of the whistle along said strap means when in a relaxed condition but prevent movement of the whistle relative to said strap means when taut about a sport glove.

18. The whistle defined in claim 17 wherein said bracket means comprises a generally rectangular shaped bracket having a pair of openings therethrough, each of said openings being defined along at least a portion of the periphery thereof by a generally straight edge, said strap means having a plurality of transverse ridges formed thereon cooperable with at least one of said generally straight edges to maintain the whistle in selected position on said strap means when taut about a glove or the like worn on the user's hand.

19. The whistle defined in claim 18 wherein said strap means comprises an elongated strap having opposite side surfaces at least one of which has a plurality of hook-like elements thereon operative to be releasably attached to the other side surface when in surface-to-surface engagement therewith.

20. The whistle defined in claim 18 wherein said bracket is secured to said bulbous shaped portion of said body so as to lie generally in a plane substantially tangent to said bulbous shaped portion.

21. The whistle defined in claim 18 wherein said bracket has at least two exposed concave surfaces and an intervening convex surface, said strap being spaced from said concave surfaces when extending between and through said openings in a longitudinally taut condition.

* * * * *